United States Patent [19]

Pelton et al.

[11] Patent Number: 5,044,974

[45] Date of Patent: Sep. 3, 1991

[54] MECHANISM FOR LOCKING A FLUORESCENT LAMP ADAPTOR

[75] Inventors: Bruce A. Pelton, Manteca; James G. O'Carroll, Emeryville, both of Calif.

[73] Assignee: Lumatech, Inc., Emeryville, Calif.

[21] Appl. No.: 559,828

[22] Filed: Jul. 30, 1990

[51] Int. Cl.[5] ..... H01R 39/00

[52] U.S. Cl. ..... 439/307; 439/645; 439/236; 439/242

[58] Field of Search ..... 439/307, 226, 227, 228, 439/231, 232, 233, 234, 236, 245, 253-257, 307, 242, 645, 13; 362/260, 296; 313/318

[56] References Cited

U.S. PATENT DOCUMENTS 4,623,823 11/1986 Engel ..... 439/232
4,624,513 11/1986 Haraden ..... 439/232
4,723,200 2/1988 Troen ..... 439/232

OTHER PUBLICATIONS

Eastrock Technology, Inc.-"New" Compact U PN Adapter with Locking Device.

*Primary Examiner*—David L. Pirlot
*Attorney, Agent, or Firm*—Bielen, Peterson & Lampe

[57] ABSTRACT

A mechanism for locking a fluorescent lamp adaptor to a standard incandescent screw-in lamp socket utilizing base member having a bottom and wall portions. The wall portion of the base member possesses an inner surface and an outer surface and an aperture extends through the wall portion. A male screw-in element is also utilized and is confined to the base member for freely rotating relative to the base member and the screw-in lamp socket. A tool urges the threaded male screw-in element into threading engagement with the standard screw-in lamp socket to permit insertion and removal of the lamp adaptor in relation to the standard screw-in lamp socket.

12 Claims, 3 Drawing Sheets

FIG-1
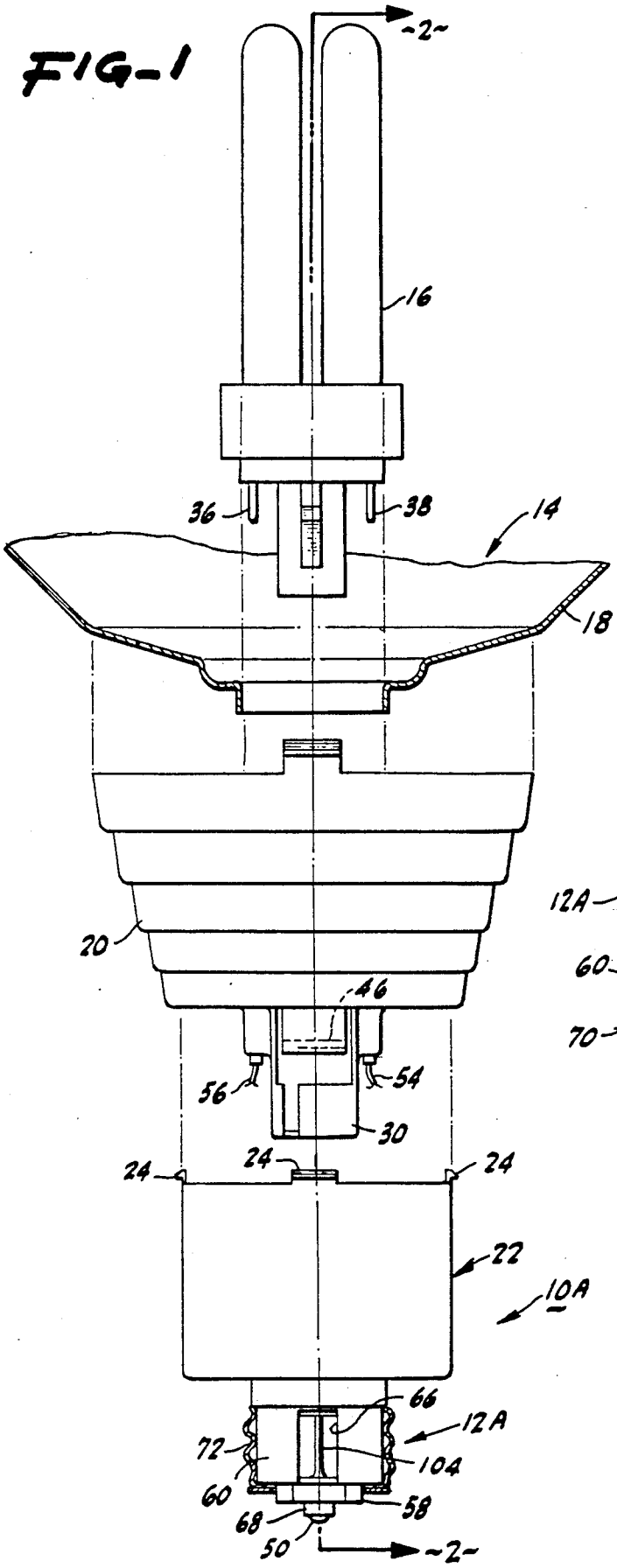
FIG-13
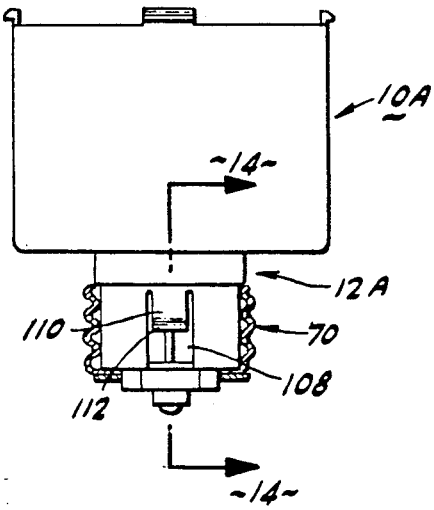
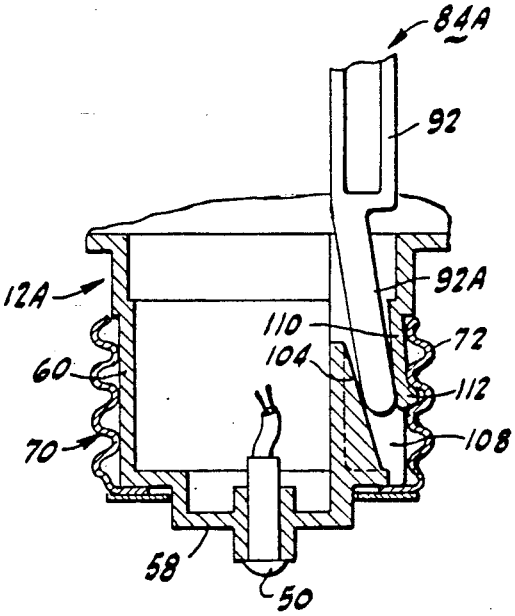
FIG-14

FIG-2
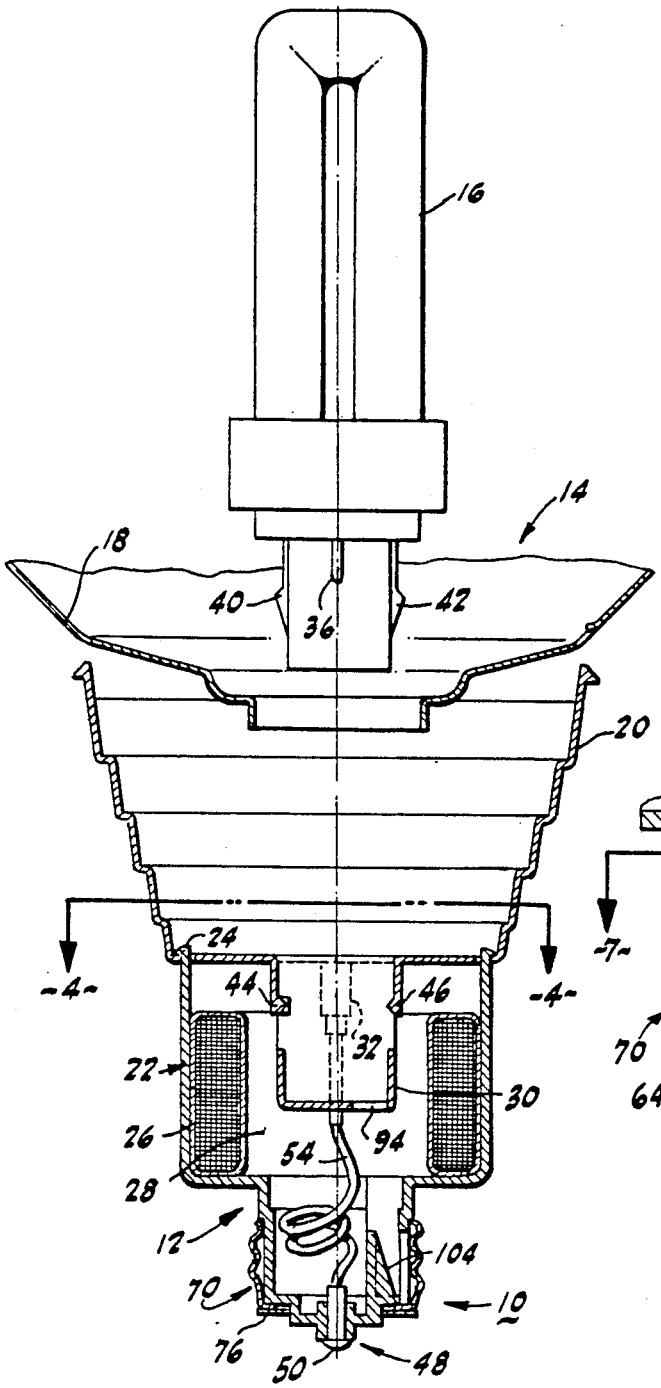
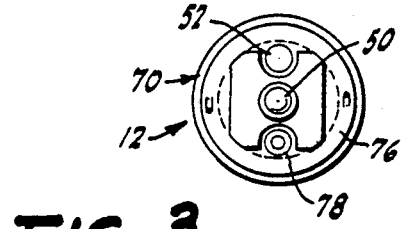
FIG-3
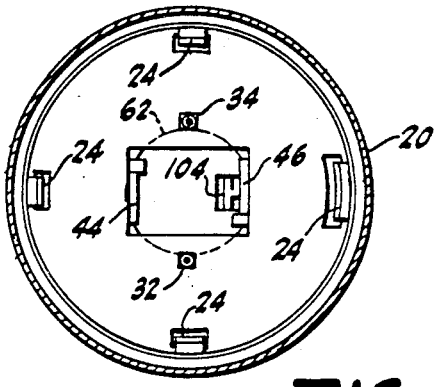
FIG-4
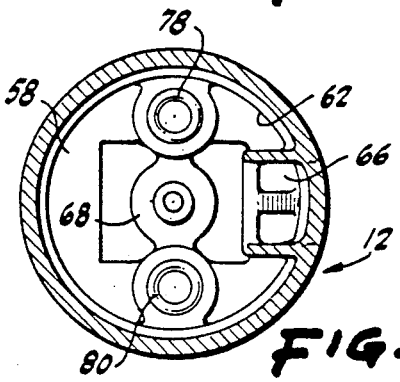
FIG-7
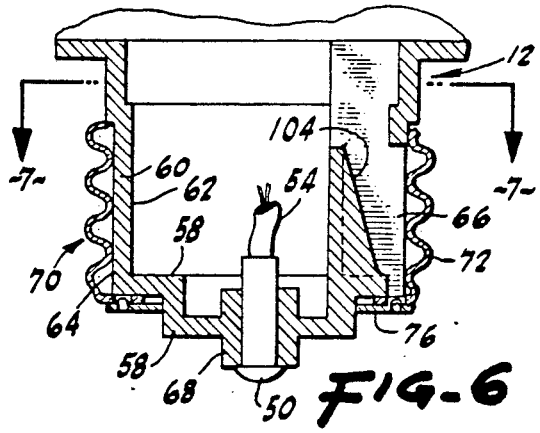
FIG-6
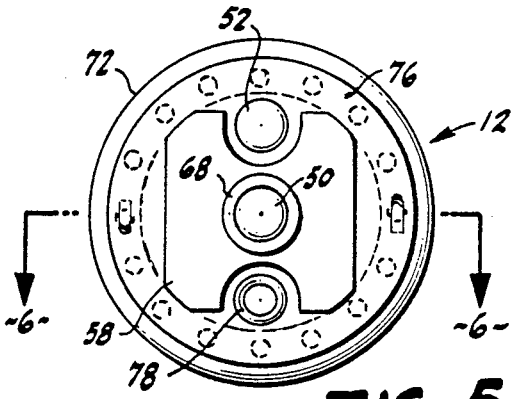
FIG-5

MECHANISM FOR LOCKING A FLUORESCENT LAMP ADAPTOR

BACKGROUND OF THE INVENTION

The present invention relates to a novel and useful mechanism for locking a fluorescent lamp adaptor to a threaded screw-in lamp socket.

Fluorescent lamps are generally accepted as being far more efficient than incandescent lamps in commercial application such as school, hospitals, hotels, restaurants, and the like. Small plug-in fluorescent lamps have been developed and are now being extensively manufactured by lighting companies. Such lamps are commonly known as parallel lamps (PL) or a quad lamps. Adaptors for such plug-in fluorescent lamps have been manufactured to achieve compatibility with the common medium base lamp socket, the standard for incandescent lamps.

For example, the Reflect-A-Star fixture manufactured by Lumatech Inc. of Emeryville, Calif. utilizes such an adaptor in conjunction with a reflector system.

Unfortunately, adaptors for fluorescent lamps are relatively expensive and are succeptable to theft when employed in an accessible application such as in a motel room.

A prior device known as the Compact-U Adapter manufactured by EastRock Technology, Inc. permits a fluorescent lamp adaptor to be locked in place within an incandescent lamp socket. It is believed that such device employs a free moving male screw-in element, known as a Edison base, which possesses a flange portion having a plurality of holes therethrough. A lock and key is inserted vertically to engage one of the plurality of openings in the Edison base flange, thus, permitting the screwing-in or screwing-out of the adapter from the lamp socket. This system requires a searching movement of the key to engage one of the plurality of openings in the Edison base flange and is succeptible to failure if the flange is bent or damaged in any way.

A locking mechanism for a fluorescent lamp adapter which overcomes the problems found in the prior art would be a notable advance in the lighting field.

SUMMARY OF THE INVENTION

In accordance with the present invention a novel and useful mechanism for locking a fluorescent lamp adapter to a threaded screw-in lamp socket is herein provided.

The mechanism of the present invention utilizes a base member which possesses a bottom and a wall portion extending therefrom. The wall portion has an inner surface and an outer surface. An aperture extends between the inner and outer surfaces of the wall portion. The base may be constructed of any rigid or semi rigid non-electrically conductive material such as plastic, resin, and the like. Such base member may also provide a support for electrical contacts necessary to power a plug-in fluorescent lamp.

The present invention also includes as one of its elements, a male screw-in element having a threaded portion. The threaded male screw-in element is positioned in surrounding relationship to the base member and is freely rotatable relative to the outer wall portion of the base member. A plate on the exterior of the base member bottom may be employed to hold the freely rotatable male screw-in element to the base member. The male screw-in element possesses a threaded portion which is capable of threadingly engaging the threaded portion of the standard screw-in incandescent lamp socket.

Means is also included in the present invention for engaging the threaded portion of the male screw-in element to confine the same to the base member for movement with the base member. In other words, such engaging means permits the user to insert the lamp adaptor into and to remove the lamp adapter from a standard incandescent socket. Such engaging means may take the form of a tool having a shaft and means for guiding the shaft to contact with the threaded male screw-in element through the aperture in the wall portion of the base member. The guiding means may take the form of a ramp found within the base member. Contact of the tool shaft with the ramp wedges the tool to the threaded portion of the male screw-in element, which negates the possibility of free rotation of the same relative to the base member. In another embodiment, the tool shaft may contact a protuberance found on flap of the base member which in turn contacts the male screw-in element to wedge the same, precluding free rotation of the element relative to the base member.

The mechanism of the present invention may also be constructed with a housing member lying adjacent the base member. The housing member encloses a toroidal ballast and jacks for the plug-in fluorescent lamp. The housing member also includes an opening or aperture for passage of the shaft of the means for engaging the threaded male screw-in element. A stop limits passage of the shaft through the housing. The shaft is formed with a flange to contact a shelf provided by the housing in this regard.

It may be apparent that a novel and useful mechanism for locking a fluorescent lamp adapter to a threaded screw-in lamp socket has been described.

It is therefor and object of the present invention to provide a mechanism for locking a fluorescent lamp adapter to a standard incandescent lamp socket which is compact and simple to manipulate.

Another object of the present invention is to provide a mechanism for locking a fluoresecent lamp adapter to a standard incandescent lamp socket which requires the use of a locking tool for the insertion of the adapter into and removal of the adapter from a standard incandescent lamp socket.

Yet another object of the present invention is to provide a mechanism for locking a fluorescent lamp adapter to a standard incandescent lamp socket which is compatible with the electrical circuitry in a lamp adapter, including a toroidal ballast component.

Yet another object of the present invention is to provide a mechanism for locking a fluorescent lamp adapter which is reliable and sturdy in its construction.

The invention possesses other objects and advantages especially as concerns particular characteristics and features thereof which will become apparent as the specification continues.

BRIEF DESCRIPTION OF THE DRAWINGS

FIG. 1 is an exploded view in elevation of the adapter locking mechanism of the present invention in conjunction with a fluorescent lamp unit reflector portion partially depicted.

FIG. 2 is a sectional view taken along line 2—2 of FIG. 1.

FIG. 3 is a bottom plan view of the locking mechanism and fluorescent lamp unit depicted in FIG. 1.

FIG. 4 is a sectional view taken along 4—4 of FIG. 2.

FIG. 5 is an enlargement of FIG. 3.

FIG. 6 is a sectional view taken along line 6—6 of FIG. 5, confined to the base member of the present invention.

FIG. 7 is a sectional view taken along line 7—7 of FIG. 6.

FIG. 13 is a side elevation view of another embodiment of the locking mechanism of the present invention.

FIG. 14 is a sectional view taken along line 14—14 of FIG. 13.

Figure 8:
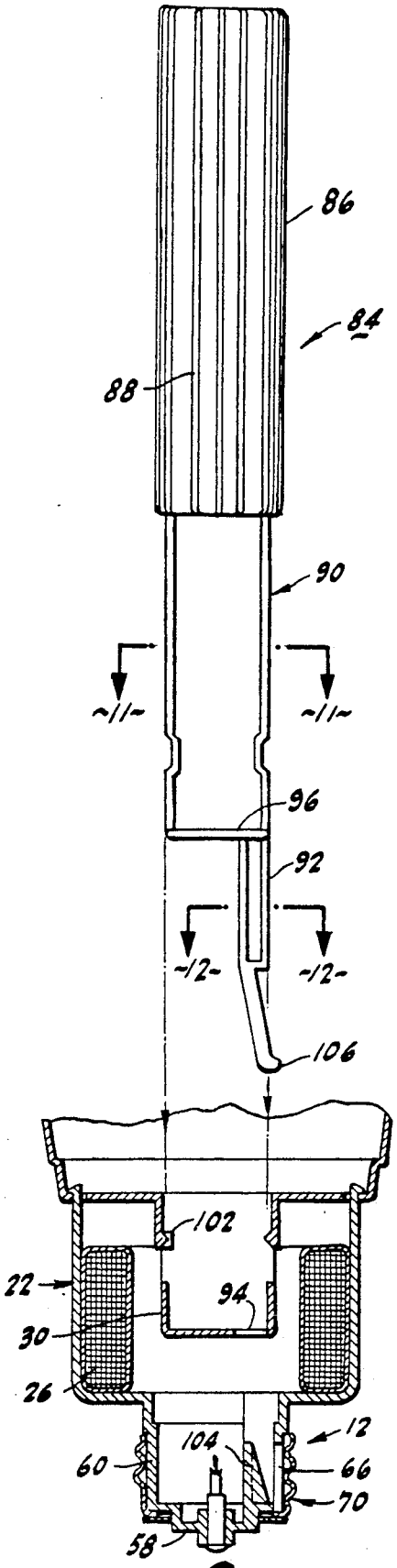
FIG. 8 is a sectional view duplicating the lower sectional view depicted in FIG. 2, showing the locking tool an exploded position relative thereto.
Figure 10:
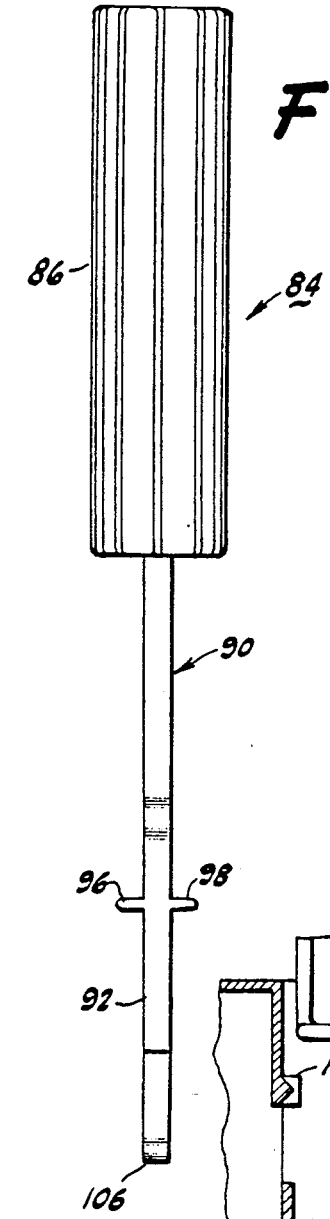
FIG. 10 is a side elevational view of the locking tool shown in FIG. 8.
Figure 11:
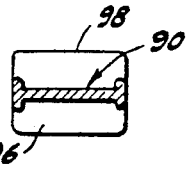
FIG. 11 is a sectional taken along line 11—11 of FIG. 8.
Figure 12:
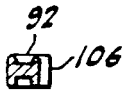
FIG. 12 is a sectional taken along line 12—12 of FIG. 8.

For a better understanding of the invention reference is made to the following detailed description of the preferred embodiments thereof which should be referenced to the hereinabove described drawings.

DESCRIPTION OF THE PREFERRED EMBODIMENTS

Various aspects of the present invention will evolve from the following detailed description of the preferred embodiments which should be taken in conjunction with the prior described drawings.

The invention as a whole is shown in the drawings by reference character 10. The locking mechanism 10 includes as one of its elements a base member 12 which may be constructed of non-electrically conducting materials such as plastic. Locking mechanism 10 and base member 12 are constructed as portion of a screw-in fluorescent lighting unit 14 adapted for use with fluorescent lamps 16. For example, fluorescent lamp 16 may take the form of a 13 watt PLQ Fluorescent Lamp manufactured by Osram. Although a reflector 18 is depicted in FIG. 1, it should be realized that fluorescent unit 14 may be employed without a reflector 18 or with other light altering items, such as a globe. Fluorescent lamp module 20 encloses the base of fluorescent lamp 16 and serves as a mounting for reflector 18. Ballast housing 22 connects to fluorescent lamp module 20 by the use of snap connector 24, FIG. 2. Toroidal ballast 26 is located within ballast housing 22 and defines a cavity 28 in the central portion thereof. Compartment 30 appends from fluorescent lamp module 20 and extends into cavity 28, providing an enclosure for electrical pin sockets 32 and 34. Electrical pins 36 and 38 of lamp 16 electrically connect to sockets 32 and 34. Ears 40 and 42 of lamp 16 are held to compartment 30 by flanges 44 and 46, FIGS. 1 and 4.

Base member 12 is depicted in the drawings as being formed integrally with ballast housing 22, FIGS. 1 and 2, although base member 12 may be distinct from ballast housing 22. Ballast housing 22 and base member 12 may be constructed of injection molded acrylic material. It should be noted that the electrical contacts 48, including contacts 50 and 52, FIGS. 2 and 5, connect to lamp pins 36 and 38 via conductors 54 and 56. The routing of conductor 56 through ballast 26 and to contact 52 is not shown in its entirety for the sake of clarity in the drawing of locking mechanism 10. Base member 12 is constructed with a bottom 58 and wall portion 60 extending upwardly therefrom. Wall portion 60 possesses an inner surface 62 and an outer surface 64 thereof. An aperture 66 passes through wall portion 60 between inner and outer surfaces 62 and 64. Boss 68 at bottom 58 of base member 12 offers support for contact 50 and electrical conductor 54, FIG. 6.

A male screw-in element 70, generally known as an "Edison base", lies in surrounding relationship with outer surface 64 of wall portion 60. Element 70 possesses a threaded portion 72 which is compatible with a standard lamp socket threaded portion 74, FIG. 9. As depicted in FIG. 2, element 70 is free wheeling relative to outer surface 64 of base member 12. Plate 76 abutts the base 58 of base member 12 and is held thereto by rivets 78 and 80, FIG. 7. It should be noted that element 70 is free to move in relation to plate 76 in the FIG. 3 depiction of mechanism 10.

Figure 9:
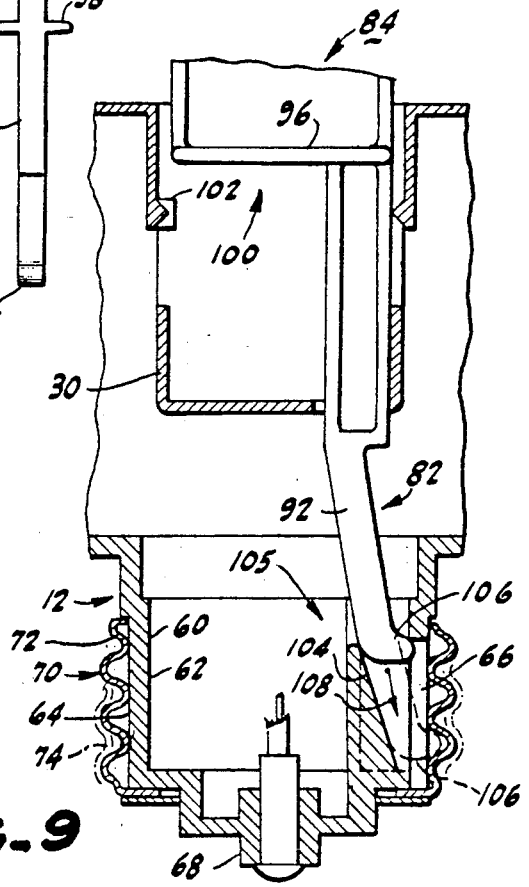
FIG. 9 is an enlargement of the lower sectional view of FIG. 8 showing the locking tool in operation within the base member.

Means 82 for engaging threaded portion 72 of element 70 and to confine element 70 to base member 12, is illustrated in FIGS. 8 and 9. Means 82, in the embodiment shown therein, includes a tool 84 having a handle portion 86 with a knurled surface 88. A shaft portion 90 of tool 84 terminates in a finger 92 which extends through opening 94 in compartment 30 within ballast housing 22. Wings 96 and 98 act as stop means 100 in conjunction with shelf 102 within compartment 30. Ramp structure 104 within base member 12 serves as guiding means 105 by presenting a sliding surface for finger 92, which causes finger 92 to extend through aperture 66 of wall portion 60 of base member 12. Tip 106 of Finger 92 engages threaded portion 72 of element 70 and causes element 70 to rotate with base member 12. Directional arrow 108 of FIG. 9 shows the sliding movement of finger 92 and the grabbing of element 70 by tip 106 of tool 84.

With reference to FIGS. 13 and 14 another embodiment of mechanism 10 is shown and is depicted by reference character 10A. Locking mechanism 10A includes a base member 12A possessing a freely rotatable male screw-in element 70 having the threaded portion 72. Tool 84 and finger 92 ride on ramp structure 104 as in embodiment 10. However, base member 12A includes an aperture 108 and a flap 110 having a ridge 112. Finger 92 sliding down ramp 104 urges ridge 112 into frictional engagement with threaded portion 72 of element 70. Again, element 70 will turn with base member 12A in this configuration.

In operation, the user of locking mechanism 10 inserts tool within compartment 30 and through opening 94. It should be noted that lamp 16 is removed from pin sockets 32 and 34 at this point. Tool 84 is then extended onto ramp 104 until stop means 100 prevents further downward movement of tool 84. At this place, tip 106 of finger 92 of tool 84 engages threaded surface 72 of element 70 to grab element 70 and prevent its previous free-wheeling disposition. Thus, element 70 is forced to turn with base member 12 allowing unit 14 to be screwed into or out of socket 74. Removal of the tool 84 from unit 14 returns element 70 to its free-wheeling deposition and prevents further movement of unit 14 into or out of socket 74. It should be noted that finger 92 of tool 84 is forced into frictional engagement with threaded surface 72 of element 70 by way of ramp 104.

In the case of embodiment 10A, FIGS. 13 and 14 tool 84A acts in a manner similar to tool 84 along ramp 104. However, tool 84A lacks the tip 106 and instead impinges on flap 110 which includes a ridge 112 that engages threaded surface 72 of element 70. Consequently, a similar grabbing occurs in which element 70 is held to base member 12A to permit unit 14 to be screwed in or screwed out of socket 74.

While in the foregoing embodiments of the invention have been set forth in considerable detail for the purpose of making a complete disclosure of the invention it may be apparent to those of skill in the art that numerous changes may be made in such details without departing from the spirit and principles of the invention.

What is claimed is:

1. A mechanism for locking fluorescent lamp adaptor to a threaded screw-in lamp socket, a. a base member including a bottom and a wall portion extending therefrom, said wall portion having an inner surface and an outer surface, said wall portion further including an aperture extending between said inner surface and said outer surface of said wall portion;

b. a male screw-in element having a threaded portion, said male screw-in element being freely rotatable relative to said outer surface of said wall portion of said base member, and being held in surrounding relationship relative to said base member, said male screw-in element being electrically conductive; and c. means for engaging said threaded portion of said male screw-in element to confine said threaded male screw-in element to said base member for movement therewith.

2. The mechanism of claim 1 in which said means for engaging said threaded portion of said male screw-in element includes a shaft and means for guiding said shaft into contact with said threaded male screw-in element through said wall portion aperture.

3. The mechanism of claim 2 in which said means for guiding said shaft into contact with said threaded male screw-in element includes a ramp for contacting said shaft.

4. The mechanism of claim 1 in which said means for engaging said threaded male screw-in element, includes a shaft, a protuberance on said base member, and means for guiding said shaft into contact with said protuberance to urge contact between said protuberance and said male screw-in element.

5. The mechanism of claim 4 in which said means for guiding said shaft into contact with said threaded male screw-in element includes a ramp for contacting said shaft.

6. The mechanism of claim 1 which further includes a housing member lying adjacent said base member, a toroidal ballast, and a jack for a fluorescent lamp, said housing including an aperture for passage of said means for engaging said threaded male screw-in element.

7. The mechanism of claim 6 which further includes a stop for arresting movement of said means for engaging said threaded male screw-in element.

8. The mechanism of claim 7 in which said means for engaging said threaded male screw-in element includes a shaft having a flange for contacting said stop.

9. The mechanism of claim 6 in which said means for engaging said threaded portion of said male screw-in element includes a shaft and means for guiding said shaft into contact with said threaded male screw-in element through said wall portion aperture.

10. The mechanism of claim 9 in which said means for guiding said shaft into contact with said threaded male screw-in element includes a ramp for contacting said shaft.

11. The mechanism of claim 10 in which said means for engaging said threaded male screw-in element, includes a shaft, a protuberance on said base member, and means for guiding said shaft into contact with said protuberance to urge contact between said protuberance and said male screw-in element.

12. The mechanism of claim 11 in which said means for guiding said shaft into contact with said threaded male screw-in element includes a ramp for contacting said shaft.

* * * * *